United States Patent [19]

Roller et al.

[11] 4,015,157

[45] Mar. 29, 1977

[54] IODINE LAMP WITH MOLYBDENUM PARTS

[75] Inventors: Robert S. Roller, Lyndhurst; Richard H. Holcomb, Chagrin Falls; George K. Danko, Bedford Heights, all of Ohio

[73] Assignee: General Electric Company, Schenectady, N.Y.

[22] Filed: June 16, 1975

[21] Appl. No.: 586,883

Related U.S. Application Data

[63] Continuation-in-part of Ser. No. 507,672, Sept. 20, 1974, abandoned.

[52] U.S. Cl. ..... 313/25; 313/184; 313/222; 313/271; 313/318

[51] Int. Cl.[2] ..... H01K 1/20; H01K 1/40; H01K 1/50

[58] Field of Search ..... 313/222, 25, 113, 271, 313/279, 318, 184

[56] References Cited

UNITED STATES PATENTS

| | | | |
|---|---|---|---|
| 3,242,372 | 3/1966 | Bonazoli et al. | 313/222 |
| 3,364,378 | 1/1968 | Beeseley | 313/113 X |
| 3,445,713 | 5/1969 | Cardwell, Jr. | 313/222 X |
| 3,515,930 | 6/1970 | Walsh et al. | 313/222 X |
| 3,538,373 | 11/1970 | Van der Linden et al. | 313/222 X |
| 3,551,722 | 12/1970 | Holcomb et al. | 313/222 |
| 3,681,640 | 8/1972 | Martin | 313/222 |
| 3,719,853 | 3/1973 | Sugano et al. | 313/222 |
| 3,798,491 | 3/1974 | Malm | 313/222 X |
| 3,829,729 | 8/1974 | Westlund, Jr. et al. | 313/222 X |
| 3,912,960 | 10/1975 | Danko | 313/222 |

*Primary Examiner*—Palmer C. Demeo
*Attorney, Agent, or Firm*—Ernest W. Legree; Lawrence R. Kempton; Frank L. Neuhauser

[57] ABSTRACT

A long life tungsten halogen lamp comprising a fused silica envelope containing a coiled tungsten filament connected across inleads sealed therein which include inner portions of molybdenum wire. The molybdenum wire has been treated to increase its ductility and reduce the concentration of impurities at the surface. The fill gas at a room temperature total pressure of at least 2,000 torr comprises nitrogen, an inert gas and an iodine-bearing component which provides from $3.1 \times 10^{-7}$ to $9.6 \times 10^{-7}$ gram atoms of iodine per cubic centimeter of envelope volume.

10 Claims, 2 Drawing Figures

IODINE LAMP WITH MOLYBDENUM PARTS

The invention relates to a long life tungsten halogen incandescent lamp comprising inner lamp parts of molybdenum and using iodine as the regenerative cycle agent, and is a continuation-in-part of our copending application Ser. No. 507,672, filed Sept. 20, 1974 and which is similarly titled and assigned and now abandoned.

Related applications are that of George K. Danko, Ser. No. 481,662, filed June 21, 1974, Halogen Lamp With Internal Molybdenum Parts, now U.S. Pat. No. 3,912,960, and that of Robert S. Roller, Richard H. Holcomb and George K. Danko, Ser. No. 502,142, filed Aug. 30, 1974, Iodine Lamp with Molybdenum Parts, now abandoned in favor of continuation-in-part application Ser. No. 586,884, filed June, 16, 1975 both similarly assigned.

BACKGROUND OF THE INVENTION

The basic idea of a regenerative cycling process to prevent blackening of the envelope of an incandescent lamp was disclosed in U.S. Pat. No. 2,883,571 — Fridrich et al., which used iodine as the regenerative agent. The concept has since been extended to bromine and chlorine and the former has been used extensively in commercially produced lamps. In such lamps the bulb contains, in addition to an inert filling gas, a reactive transport gas formed by the halogen component which reacts with tungsten evaporated from the filament and deposited on the envelope wall. The transport gas forms a volatile compound with the tungsten which breaks down in the vicinity of the hot filament to redeposit tungsten on the filament. As a result, the bulb wall remains free of blackening and the emitted lumens per watt remain substantially constant til the end of life. However redeposition of tungsten on the filament is not uniform and life ends when the filament burns through in one place.

Correct and satisfactory operation of a halogen regenerative cycle in an incandescent lamp requires that the dimensions of the lamp be chosen so that during operation the temperature of the bulb wall will not permit excessive condensation of tungsten oxyhalides at the wall. Generally a tubular envelope is used with the filament lying on axis, the distance from filament to bulb wall being chosen so that during operation the bulb wall temperature is everywhere above the required minimum. Of course the same lamp operated within an outer jacket will encounter higher temperature conditions than when burnt in open air, that is without a jacket.

The regenerative halogen cycle can be disturbed by the presence within the lamp of a metal, whether present merely as an impurity or deliberately introduced, capable of reacting with the halogen and forming a nonvolatile compound therewith in the lamp because this results in the halogen being withdrawn from the cycle. However the results can also be bad if volatile compounds of the metal are formed, particularly if a transport cycle is set up that removes the metal from some critical place and deposits it elsewhere. For instance if the filament supports are made of such metal and attacked, they can be rapidly cut through and the lamp destroyed.

SUMMARY OF THE INVENTION

The object of the invention is to make an improved long lived tungsten halogen lamp using iodine for the regenerative carrier gas and containing inner leads and supports of molybdenum.

Our invention resulted from attempts to replace tungsten by more ductile molybdenum for the inner leads and filament supports in a tungsten iodine lamp. Standard grades of molybdenum are capable of from 6 to 10% elongation. We used molybdenum wire which is better than 99.9% molybdenum and which has been surface-etched and annealed in order to improve its ductility to a minimum of 15% elongation. The surface etching serves to remove impurities and in particular iron which are much more concentrated at the surface than in the core of the wire. Such high ductility molybdenum wire is sufficiently ductile that it can be cold-worked without fracturing or embrittlement which makes it possible to manufacture the lamp mount on high speed automatic equipment, as taught in the previously mentioned Danko application.

We have now found an unexpected advantage of long useful life from the use of such high ductility molybdenum in a lamp due to the decrease in wall blackening normally observed in iodine lamps containing molybdenum. The iodine must be present as part of a fill gas comprising nitrogen which serves as an arc suppressor, and an inert gas such as argon. In a lamp wherein the wall temperature immediately surrounding the filament is at least about 700° C and the cold spot temperature at the ends of the envelope is at least about 250° C, the useful range of iodine or iodine-providing component extends from $3.1 \times 10^{-7}$ to $9.6 \times 10^{-7}$ gram atoms per cubic centimeter of envelope volume. The presence of molybdenum in the lamp seems to have a beneficial effect by gettering some of the oxygen and oxygen-containing species and thereby lowering the degenerative cycle activity at the coil. This effect yields a high potential for long-life operation.

DESCRIPTION OF PREFERRED EMBODIMENTS

Figure 1:
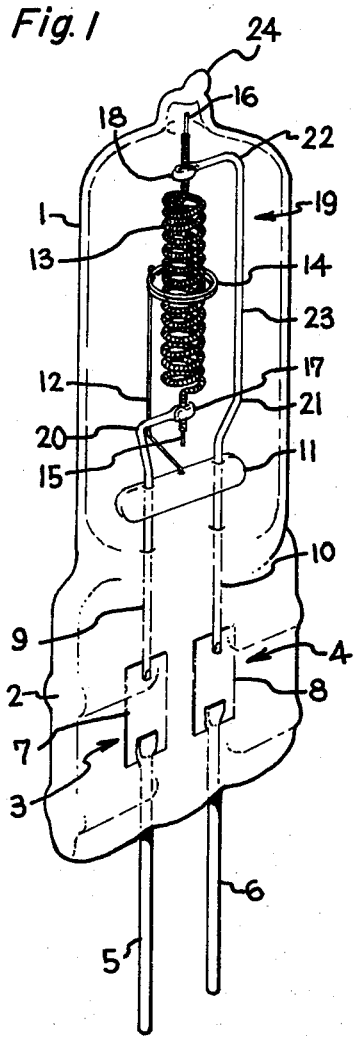
FIG. 1 is a pictorial view of a single-ended lamp embodying the invention.

Referring to FIG. 1 of the drawing, the lamp shown therein by way of example is of the tubular single-ended type comprising a tubular envelope 1 preferably made of fused silica or of a glass of high softening point and containing over 96% silica. The lower end of the envelope is provided with a pinch seal 2 through which are sealed in-leads 3,4 respectively comprising outer conductors 5,6 welded to molybdenum foils 7,8 which in turn are welded to inner conductors 9,10. Inner conductors 9,10 within the bulb extend through a bead 11 of fused silica which serves as a brace in which supporting wire 12 is also secured. The incandescible tungsten filament is formed into a coiled coil helix 13 which extends axially of the envelope through loop 14 in supporting wire 12. The filament coil contains spuds 15,16 in its ends which are seized in clamps 17,18 of inner conductors 9,10, respectively.

In the manufacture of the lamp the internal assembly or mount 19 comprising the inleads 3,4 extending through bead 11 and with filament 13 clamped across their ends is assembled first. This may be done by the automated process described in U.S. Pat. No. 3,850,489—Jarc et al. In this process the inner conductors 9,10 are preformed by cold working molybdenum wire to give the desired length and geometry including the bends at 20 in conductor 9 and at 21 and 22 in conductor 10. The inleads are secured to bead 11 along with support wire 12, loop 14 being open at this point in the processing. Filament 13 has short lengths of wire or spuds 15, 16 frictionally retained in its straight ends and whose function is to prevent crushing the primary turns of the filament by the clamps. Filament coil 13 is clamped at 17 and 18 to the ends of inner conductors 9 and 10, respectively, and may be tensioned by straightening out a bend, not shown in the drawing, previously provided at location 23 in inner conductor 10. Following this, loop 14 is closed around the filament and the molybdenum foils 7,8 and outer conductors 5,6 are connected to the ends of conductors 9,10.

To complete the manufacture of the illustrated lamp, the mount 19 is held in place within envelope 1 which at this stage has an exhaust tube coming out its upper end. Fires are played on the lower end while a protective gas, suitably nitrogen, is flowed through to prevent oxidation of the metal parts. Pinch jaws then squeeze the softened silica to make a hermetic seal with the molybdenum foils 7,8. The lamp is then flushed and filled with the operating gas mixture through the exhaust tube which is then tipped off leaving the residue shown at 24. Spud 16 penetrates the residual exhaust tube cavity and thereby braces the upper end of the filament.

The illustrated lamp is a 250 watt size for 120 volt operation and its commercial version has been designed 250 W FT-11. It uses inner conductors 9,10, support wire 12 and spuds 15,16 of tungsten. When tungsten parts are used for the inner conductors, the bends require heat treatment in order to avoid fracture and clamps are not practical. The present invention resulted from attempts to replace tungsten by molybdenum for all the internal metal parts except the filament in order to permit more automation.

Commercially available molybdenum wires known as type R, 99.95% molybdenum, and type KW, 99.90% molybdenum, were originally tried as substitutes for tungsten. Although less expensive than tungsten, these grades of molybdenum are comparatively brittle having a percentage elongation varying between 6% and 10%. With this degree of brittleness or lack of ductility, it was difficult to manufacture the mounts on high speed equipment due to fracture of the molybdenum at the clamps. We then used molybdenum wire which has been surface-etched and annealed to improve its ductility and which is capable of at least 15% elongation without rupture. We have successfully used wire having percent elongation varying from 17.5 to 30.7, and prefer wire having a percent elongation of 20 or better. The elongation was measured at room temperature using a standard tensile tester, the gauge length, that is the length of wire sample between the tester jaws, being 5 inches, and the cross-head speed, 0.2 inches per minute. The greater ductility of this wire permits a much greater degree of cold working and it became relatively easy to make the bends and do the various flattening and tensioning operations on high speed automatic equipment.

The limitations on the amount of carrier gas, that is iodine or an iodine-bearing component and oxygen that can be used in an all-tungsten regenerative cycle lamp are set by the regenerative cycle activity necessary to prevent tungsten from depositing on the bulb wall, and the degenerative cycle activity that reduces lamp life by tungsten transport along the filament coil. When the tungsten is replaced by molybdenum for the inner lamp parts exclusive of the filament, there are chemical reactions taking place involving molybdenum with iodine, oxygen, hydrogen and carbon, in addition to the usual ones involving tungsten with the same elements. Surprisingly, when the gas fill including the iodine concentration was optimized for the new high ductility molybdenum, a great improvement in useful lamp life was obtained due to the decrease in lamp wall blackening. Whereas previously lamps containing molybdenum and iodine had sown a considerable tendency to blacken, these lamps utilizing the high ductility molybdenum demonstrated the same 6000 hours of life as observed in the iodine-tungsten lamps.

The concentration of iodine required is related to the temperature at which the lamp envelope operates and is less at higher temperatures. We have found it desirable to have the wall temperature immediately surrounding the filament at least about 700° C, and the low point or minimum temperature at the ends of the envelope at least about 250° C to prevent condensation of compounds of tungsten or molybdenum with iodine thereat. For these conditions, the gas fill should comprise a minor percentage of nitrogen which serves as an arc suppressor, a major percentage of an inert gas such as argon, and from $3.1 \times 10^{-7}$ to $9.6 \times 10^{-7}$ gram atoms of iodine per cubic centimeter of envelope volume. For adequate lamp life and quality, we find in practice a minimum pressure of 2000 torr necessary. The upper limit of pressure is set by the strength of the envelope at operating temperature and the need for a safety factor. With fused silica envelopes of conventional wall thickness (1 mm), we find the range of 2500 to 3500 torr to be most suitable. A suitable gas fill comprises 12% nitrogen and 88% argon by volume at a room temperature fill pressure of 3000 torr, and $4.8 \times 10^{-7}$ gram atoms of methyl iodide per cc of envelope volume. Such quantity of methyl iodide corresponds to about 0.3% by volume at a total fill pressure of 3000 torr. The iodine need not necessarily be provided as the element; it can be present as an iodo-substituted hydrocarbon, for instance methyl iodide.

The lower limit in the permissible iodine concentration above is determined by the amount of tungsten which can be tolerated on the bulb wall. With less than approximately $3.1 \times 10^{-7}$ gram atoms of iodine per cc, the lamp blackens after a number of hours of operation. Iodine in excess of approximately $9.6 \times 10^{-7}$ gram atoms per cc causes excessive absorption of light from the filament.

In lamps using tungsten parts along with iodine, oxygen, and carbon, the level of carbon monoxide, CO, shows very little decrease even after 2500 hours of burning. The oxygen may be added to the lamp or may be present as an impurity; the carbon may be present as an impurity on the metal parts, or may result from a processing step involving the use of hydrocarbons, or may result from decomposition of methyl iodide. However, in similar lamps using molybdenum inner parts, there is a drop in the CO level to below detectable limits (50 ppm) within about 100 hours of burning. Although this phenomenon is not totally understood, it is believed to be due to the gettering by molybdenum of oxygen and oxygen-containing compounds.

As much as 0.1% oxygen corresponding to $1.6 \times 10^{-7}$ gram atoms per cc has been added to lamps of the invention with no adverse effects. At the present time, the maximum allowable quantity of oxygen is not known. However, it is known that a lamp, such as the lamp of the invention, containing high ductility molybdenum can tolerate a higher level of oxygen as compared to prior art lamps using tungsten inner lamp parts.

Figure 2:
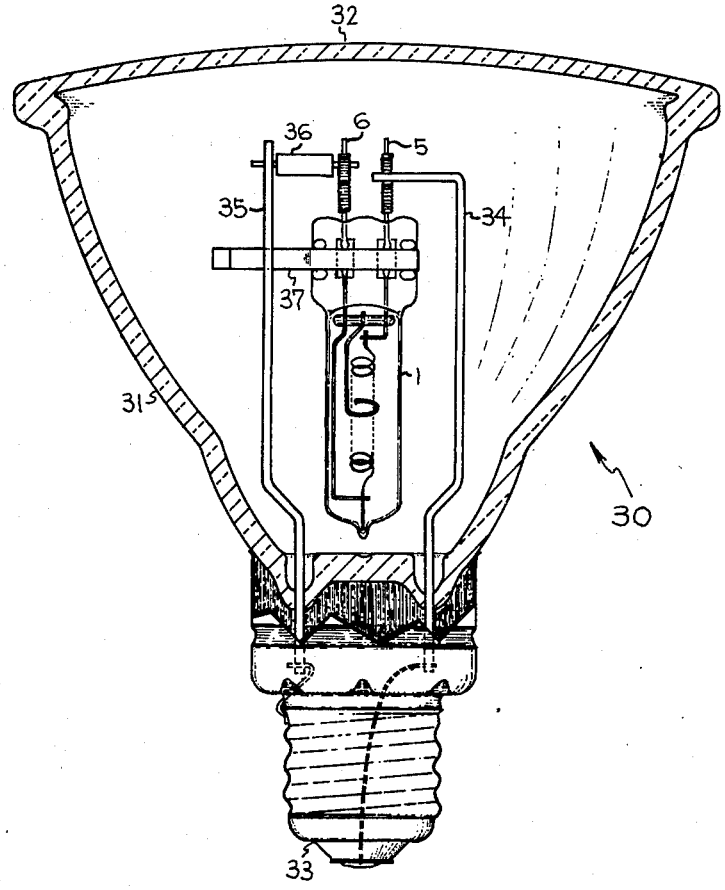
FIG. 2 is a sectioned side view of a double envelope lamp, the inner envelope corresponding to the lamp of FIG. 1.

The lamp illustrated in FIG. 1 will operate at the required temperatures, namely at least 700° C at the wall surrounding the filament and at least 250° C at the low point, when used as the internal light source within an outer envelope. FIG. 2 shows a typical combination wherein lamp envelope 1 is mounted within an outer vitreous jacket 30 comprising a generally parabolic reflector portion 31, a lens or face portion 32 and a screw base 33. Outer conductors 5 and 6 of the inner envelope are attached to conductors 34, 35 of the outer jacket. A fuse 36 is inserted between the conductors 6 and 35 to protect the operating circuit against high current surges caused by arcing upon inner lamp failure. The inner envelope is additionally secured to conductor 35 by strap 37 to prevent damage from shock or vibration. The outer jacket is preferably filled with an inactive gas such as nitrogen and it is known commercially as a PAR 38 reflector jacket.

The inner lamp 1 may of course be used as the light source within other outer envelopes than that illustrated in FIG. 2. It may also be operated in air without an outer envelope, and a clear wall and long life will be had, provided the previously stated minimum temperature conditions are complied with. It has been observed that a par jacket as described raises the average wall temperature by about 200° C. In clear air when the lamp is operated vertically, the limiting condition is generally too low a temperature at the walls due to a phenomenon known as nitrogen blackening which is observed in lamps containing iodine and nitrogen when the wall temperature falls below a minimum value of about 700° C. The temperature may be raised by means of a fixture which reflects heat to the lamp wall and limits heat loss by convection. At a given wattage input, the envelope temperature may of course be raised by redesigning the envelope to a smaller size. The upper limit to envelope temperature is set primarily by softening of the envelope material, about 1200° C in the case of the fused silica commonly used.

We have analyzed the high ductility molybdenum wire used in our improved lamps and compared it with commercial grade low ductility molybdenum wire to determine the reason for the great decrease in lamp wall blackening obtained when the gas filling is optimized for such wire. Commercial grade low ductility molybdenum wire is black wire in an as-drawn condition with only hydrogen annealing. High ductility wire is the same wire which has been subjected to a caustic etching wherein approximately 3% by weight of the material from the outer surface is removed. When pure material is made into wire by drawing it through dies, any impurities which are introduced should occur at the surface. Therefore it is reasonable to expect that surface leaching should remove the greater part of any impurities that have been introduced. Our analysis has shown that this is in fact what happens and the significant impurity appears to be iron. In the as-drawn wire, iron is present as an impurity at the surface in a concentration which is probably in excess of 100 parts per million, but in the core of the same wire the concentration is only approximately 43 parts per million. When the same wire is caustic-etched to increase its ductility and the iron impurity concentration is again measured, it is approximately 50 parts per million at the surface and is unchanged in the core. Thus the effect of the treatment is to reduce the concentration of impurities at the surface to a level much closer to that existing within the core of the wire and in any event to a level less than twice that within the core.

The foregoing conclusions have been derived from a study of Table 1 below which gives the results of optical emission spectrograph analysis on low and high ductility samples of two sizes of molybdenum wire, 0.012 inch and 0.020 inch. The procedure used was to etch the sample by an aqueous solution of hydrogen peroxide until the indicated percentage by weight of molybdenum had been removed. The solution is then evaporated and the dry powder is burned in an electric arc in air between carbon electrodes. The spectral lines produced are then analyzed by a calibrated spectrograph and the result is recorded in the table as the "surface" figure. The wire sample is then completely dissolved in the etching solution which is again dried and the powder burned in the electric arc: the impurity level determined by spectral emission measurement is recorded under the "core" figure.

TABLE 1 - IMPURITY LEVELS

| | As Drawn Wire | | | | Caustic Etched Wire | | | |
|---|---|---|---|---|---|---|---|---|
| | .012" dia. | | .020" dia. | | .012" dia. | | .020" dia. | |
| | Surface | Core | Surface | Core | Surface | Core | Surface | Core |
| Fe | 80 | 43 | 80 | 39 | 50 | 41 | 61 | 43 |
| Cr | 23 | 18 | 24 | 17 | 18 | 14 | 20 | 17 |
| Ni | 13 | 8 | 10 | 9 | 10 | 7 | 11 | 8 |
| Ca | 13 | 13 | 13 | 13 | 13 | 13 | 13 | 13 |
| Cu | 4 | 4 | 5 | 4 | 5 | 4 | 10 | 5 |
| Mn | 14 | 16 | 17 | 17 | 18 | 15 | 19 | 16 |
| Mg | 10 | 10 | 12 | 10 | 12 | 11 | 16 | 10 |
| Sn | 16 | 23 | 15 | 22 | 15 | 22 | 20 | 27 |
| Co | 8 | 8 | 8 | 8 | 8 | 8 | 8 | 8 |
| Ti | 10 | 10 | 10 | 10 | 10 | 10 | 10 | 10 |
| Pb | 10 | 10 | 10 | 10 | 10 | 10 | 10 | 10 |
| Zr | 10 | 10 | 10 | 10 | 10 | 10 | 10 | 10 |
| Wr.% | | | | | | | | |

-continued

TABLE 1 - IMPURITY LEVELS

| | As Drawn Wire .012" dia. | | As Drawn Wire .020" dia. | | Caustic Etched Wire .012" dia. | | Caustic Etched Wire .020" dia. | |
|---|---|---|---|---|---|---|---|---|
| | Surface | Core | Surface | Core | Surface | Core | Surface | Core |
| removed | 2.96 | | 4.42 | | .305 | | 4.18 | |

The table shows a very definite difference between the "as drawn" wire and the caustic etched wire in the level of iron impurity. Although the surface level in both sizes of "as drawn" wire is recorded merely as greater than 80 parts per million because that was the upper limit of the spectrograph's calibration for iron, in fact it was much higher than 80 ppm. Other measurements made by atomic absorption indicate an iron impurity concentration at the surface of about 160 ppm. In the caustic etched wire the surface level of iron impurity is much lower being 50 ppm for the 0.012 inch wire size and 61 ppm for the 0.020 inch wire size. The iron impurity level at the core is approximately 40 ppm for both wire sizes with no significant difference between the "as drawn" and caustic etched samples.

The table also shows lower surface concentrations of chromium and nickel in the caustic etched wire when compared with the "as drawn". Again the concentration is higher at the surface than at the core and the difference is reduced by caustic etching. The difference in the levels of the other impurities measured and reported in the table do not appear to be significant.

When the caustic etched wire samples are viewed under a microscope, the surface looks considerably better than in the "as drawn" wire. The caustic etching removes many surface impurities including voids which can harbor contaminants.

Our study has led us to believe that high ductility molybdenum wire makes possible a long life iodine regenerative cycle lamp with clean lamp walls because the wire surface is cleaner than in low ductility wire, and in particular because the iron impurity level is lower. This accords with the known deleterious effect of iron in a tungsten halogen lamp and which has always prevented the use of iron inleads and parts within the envelope.

In the lamps that we have made having improved lamp lives of 4000 hours or more, the molybdenum wire which is at least 99.9% pure and has the concentration of iron impurity at the surface reduced to a level less than twice that within the core and preferably no greater than 1.5 times that within the core. The preferable condition corresponds to an iron impurity level not exceeding approximately 60 parts per million. Ideally, of course, the wire should be perfectly clean so that the iron impurity level at the surface is no greater than in the core but such a condition is too difficult and expensive to achieve in practice. We believe that the lower impurity level allows us to use a lower level of iodine which results in the longer lives that we have observed in our lamps.

What we claim as new and desired to secure by Letters Patent of the United States:

1. A halogen regenerative cycle incandescent lamp comprising a compact envelope of light-transmitting material of high softening temperature, inleads including inner portions of molybdenum sealed into said envelope, an incandescible tungsten filament coil connected across said inner portions, the distance from the filament to the envelope wall being small enough that the inner wall temperature immediately surrounding the filament is at least about 700° C and the low point temperature is at least about 250° C during operation, said inner portions being of molybdenum wire which has been treated to increase its ductility to a minimum elongation of 15% and reduce the concentration of impurities at the surface, and a fill gas comprising nitrogen, an inert gas and an iodine-providing component at a total minimum pressure of 2000 torr, said component providing from $3.1 \times 10^{-7}$ to $9.6 \times 10^{-7}$ gram atoms of iodine per cubic centimeter of envelope volume.

2. A lamp as in claim 1 wherein said high ductility molybdenum wire has a minimum elongation of about 20%.

3. A lamp as in claim 1 wherein said high ductility molybdenum wire is at least 99.9% pure with the concentration of Fe impurities at the surface less than twice that within the core of the wire.

4. A lamp as in claim 1 wherein said high ductility molybdenum wire is at least 99.9% pure with the concentration of Fe impurities at the surface no greater than approximately 1.5 times that within the core of the wire.

5. A lamp as in claim 1 wherein said high ductility molybdenum wire is at least 99.9% pure with the concentration of Fe impurities at the surface no more than approximately 60 parts per million.

6. A lamp as in claim 1 wherein the inert gas is argon and the iodine-providing component is an iodo-substituted hydrocarbon.

7. A lamp as in claim 1 wherein the inert gas is argon and the iodine-providing component is methyl iodide $CH_3I$.

8. A lamp as in claim 1 wherein the fill gas is approximately 12% nitrogen and 88% and the iodine-providing component is methyl iodide $CH_3I$.

9. A lamp as in claim 8 wherein the envelope is fused silica and the fill gas pressure is from 2500 to 3500 torr.

10. A lamp as in claim 1 combined with an outer jacket enclosing it, said outer jacket being hermetically sealed and containing nitrogen.

* * * * *